US008376791B2

(12) United States Patent
Chiecchi

(10) Patent No.: US 8,376,791 B2
(45) Date of Patent: Feb. 19, 2013

(54) METHOD FOR CONTROLLING A SURFACE DRIVE FOR A WATERCRAFT

(75) Inventor: Andrea Chiecchi, Verona (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 284 days.

(21) Appl. No.: 12/678,871

(22) PCT Filed: Dec. 6, 2007 (Under 37 CFR 1.47)

(86) PCT No.: PCT/EP2007/063437

§ 371 (c)(1), (2), (4) Date: Jul. 22, 2010

(87) PCT Pub. No.: WO2009/046768

PCT Pub. Date: Apr. 16, 2009

(65) Prior Publication Data

US 2011/0143608 A1 Jun. 16, 2011

(30) Foreign Application Priority Data

Oct. 5, 2007 (DE) ..... 10 2007 048 058

(51) Int. Cl.
*B63H 20/08* (2006.01)
*G05D 3/00* (2006.01)

(52) U.S. Cl. ..... 440/53; 701/21

(58) Field of Classification Search ..... 701/21; 440/1, 53, 61 S, 61 T, 61 G, 87
See application file for complete search history.

(56) References Cited

U.S. PATENT DOCUMENTS

| | | | | |
|---|---|---|---|---|
| 3,774,568 | A | 11/1973 | Borst et al. | |
| 4,225,148 | A | 9/1980 | Andersson | |
| 4,531,427 | A | 7/1985 | Nilsson | |
| 4,544,362 | A | 10/1985 | Arneson | |
| 4,645,463 | A * | 2/1987 | Arneson | 440/57 |
| 4,861,292 | A * | 8/1989 | Griffiths et al. | 440/1 |
| 4,931,025 | A | 6/1990 | Torigai et al. | |
| 4,939,660 | A | 7/1990 | Newman et al. | |
| 5,118,315 | A | 6/1992 | Funami et al. | |
| 5,167,546 | A | 12/1992 | Whipple | |
| 5,169,348 | A | 12/1992 | Ogiwara et al. | |
| 5,203,727 | A | 4/1993 | Fukui | |
| 5,263,432 | A * | 11/1993 | Davis | 114/286 |

(Continued)

FOREIGN PATENT DOCUMENTS

| | | |
|---|---|---|
| CN | 1237524 A | 12/1999 |
| DE | 569 396 | 1/1933 |

(Continued)

OTHER PUBLICATIONS

State Intellectual Property Office of the People's Republic of China. Notification of the First Office Action. 6 pages, Apr. 18, 2012.

*Primary Examiner* — Lars A Olson
*Assistant Examiner* — Anthony Wiest
(74) *Attorney, Agent, or Firm* — Davis & Bujold, PLLC

(57) ABSTRACT

A surface drive for a watercraft (100) that is operated in different operating ranges dependent on a speed of the watercraft (100). A trim angle (τ) is adjusted automatically in at least one operating range, via a closed control loop, with detection of preset regulating parameters and is automatically controlled, in at least one other operating range, with detection of preset control parameters in a manner established for the operating range.

23 Claims, 6 Drawing Sheets

U.S. PATENT DOCUMENTS

| | | | | |
|---|---|---|---|---|
| 5,326,294 | A | 7/1994 | Schoell | |
| 5,385,110 | A | 1/1995 | Bennett et al. | |
| 5,549,493 | A | 8/1996 | Bezzi | |
| 5,647,780 | A | 7/1997 | Hosoi | |
| 5,785,562 | A | 7/1998 | Nestvall | |
| 6,431,928 | B1 | 8/2002 | Aarnivuo | |
| 6,726,511 | B1 | 4/2004 | Schelman | |
| 6,843,195 | B2 * | 1/2005 | Watabe et al. | 114/144 E |
| 6,899,196 | B2 | 5/2005 | Husain et al. | |
| 6,908,350 | B1 | 6/2005 | Roessler et al. | |
| 6,997,763 | B2 * | 2/2006 | Kaji | 440/1 |
| 7,137,347 | B2 | 11/2006 | Wong et al. | |
| 7,295,905 | B2 | 11/2007 | Yao et al. | |
| 7,416,456 | B1 * | 8/2008 | Gonring et al. | 440/1 |
| 7,565,876 | B2 * | 7/2009 | Wilson et al. | 114/122 |
| 7,568,549 | B2 | 8/2009 | Wun et al. | |
| 2004/0139903 | A1 | 7/2004 | Watabe et al. | |
| 2005/0170712 | A1 | 8/2005 | Okuyama | |
| 2005/0176312 | A1 * | 8/2005 | Walser et al. | 440/2 |
| 2006/0042532 | A1 | 3/2006 | Wong et al. | |
| 2007/0068438 | A1 | 3/2007 | Mizutani | |

FOREIGN PATENT DOCUMENTS

| | | | |
|---|---|---|---|
| DE | 31 30 518 | A1 | 4/1982 |
| DE | 42 13 561 | A1 | 10/1992 |
| DE | 101 58 870 | A1 | 5/2003 |
| DE | 10 2004 050 014 | A1 | 6/2005 |
| DE | 10 2005 036 686 | A1 | 12/2005 |
| DE | 699 22 397 | T2 | 12/2005 |
| DE | 11 2004 001 258 | T5 | 10/2006 |
| EP | 0 102 579 | A2 | 3/1984 |
| EP | 1 770 008 | A2 | 4/2007 |
| EP | 1 792 802 | A2 | 6/2007 |
| JP | 2-279495 | A | 11/1990 |
| WO | 99/22989 | A1 | 5/1999 |

* cited by examiner

METHOD FOR CONTROLLING A SURFACE DRIVE FOR A WATERCRAFT

This application is a National Stage completion of PCT/EP2007/063437 filed Dec. 6, 2007, which claims priority from German patent application serial no. 10 2007 048 058.1 filed Oct. 5, 2007.

FIELD OF THE INVENTION

The invention relates to a method for controlling a surface drive for a watercraft.

BACKGROUND OF THE INVENTION

In fast, motor-driven watercrafts that are equipped with a surface drive, the propeller shaft can pivot in all directions around a hinge point with the drive shaft from the motor or the transmission. The motor and transmission are located in the ship's hull. The depth of immersion of the propeller and with it the conversion of drive energy into thrust is changed by pivoting the propeller in a vertical plane parallel to the longitudinal axis of the watercraft. This pivoting of the propeller shaft in the vertical plane is called trimming, and the amount of pivoting is called the trim angle. At higher headway speeds and with the propeller only partially immersed, the surface drive reaches its best efficiency. The optimal trim angle thus depends on the headway speed of the watercraft and is approached manually in ordinary watercraft, with the corresponding inaccuracy. In addition, manual trimming burdens the boat's skipper in addition to his other tasks, which likewise makes it difficult to set the optimal trim angle.

The prior art describes an automatic trim control for a surface drive that automatically adjusts the trim angle as a function of the particular operating range. The operating ranges are defined by the position that the watercraft assumes in the water at different speeds.

SUMMARY OF THE INVENTION

The underlying purpose of the invention is to specify a method for the optimized automatic setting of the trim angle of a surface drive for a watercraft for the particular operating range.

A surface drive for a watercraft consists of at least one drive unit in which a propeller shaft with a propeller is guided in a thrust tube. The thrust tube is fastened to pivot in the hinge point at the stern of the watercraft, and the propeller shaft has a hinged connection to the drive shaft in the hinge point. The drive shaft is either driven directly by a motor placed inside a hull of the watercraft, or by an output shaft of a transmission downstream from the motor. Pivoting of the thrust tube and with it the propeller shaft in a vertical plane parallel to the longitudinal axis of the watercraft is called trimming, where the trim angle is a measure of the pivoting and is limited by an upper and a lower trim boundary. The depth of immersion of the propeller is set with the trimming motion. The direction of travel of the watercraft is controlled by pivoting the thrust tube in the horizontal plane, where the measure of this pivoting is the steering angle that varies between a left and a right maximum steering angle. To execute the pivoting motions in both planes, the thrust tube is actuated by a trim actuator mechanism and a steering actuator mechanism, both of which in turn are controlled by an electronic control unit. The surface drive is operated in at least two different operating ranges so that adjustment of the trim angle is regulated automatically in at least one operating range in a closed control loop with recognition of preset control parameters. In at least one other operating range, the trim angle is automatically controlled in a manner established for this operating range depending on preset control parameters. The automatic change of the trim angle is hereinafter referred to as automatic trimming, and the different manner of trimming depending on the operating range is called the operating mode.

The advantages of automatic trimming include, among others, the setting of an optimal trim angle for each situation, so that operation can occur with the best thrust or the most favorable efficiency for the given requirements, and the skipper's workload can be reduced.

The operating ranges in one possible embodiment are defined by an upper and a lower rotational speed limit or a headway speed limit proportional to them based on the speed of the watercraft. The rotational speed limit and the headway speed limit are programmed into the electronic control unit.

In an advantageous variant of the method, changing operating ranges causes the trim modes in question to automatically change to the particular rotational speed limit or headway speed limit.

In one variant, the trim angles set as a function of the rotational speed or the headway speed are taken from a value table or a characteristic stored in the electronic control unit, with intermediate values being interpolated. Another variant for at least one operating range is the detection of the rotational speed or the headway speed, with which the particular trim angle is calculated in the electronic control unit by means of a function stored there.

In addition, a desired rotational speed newly input via a manual data input, for example a control panel, is recognized as such only when it exceeds a hysteresis range that has been established based on operational rotational speed variations.

In a refinement of the invention, all rotational speeds of the drive are proportional to one another as long as no slippage occurs. In special cases when using a stepped gear transmission in a drive train, the rotational speed of the drive or propeller proportional to the rotational speed of the motor can be calculated with regard to the transmission ratio.

In a special embodiment of the invention, in at least one operating range with accelerated drive, the changeover and with it the change of control mode changes to a faster operating range with a higher rotational or headway speed limit than is the case during deceleration, when the faster operating range reverts again to the slower. The headway speed, which constitutes an important parameter in the method, is calculated from the rotational speed of the propeller shaft or from the rotational speed of the motor proportional to it or is detected by a measuring device, which can be, for example, an ultrasound sensor, a radar system, a pitot tube, or a satellite- and/or radio-assisted navigation or position-determining system.

In an advantageous refinement there is, in addition to the at least one controlled operating range and the at least one regulated operating range, a slow-travel range for slow travel, for example while maneuvering. This slow-travel range extends from a first rotational speed limit that is determined by the idling speed of the motor, to a second rotational speed limit. In this operating range, automatic trimming is passive, which is not equivalent to manual operation, since although the trim angle can be changed manually by the skipper as desired without intervention by the electronic control unit into the trim actuator mechanism, the automatic control mode for the second operating range is automatically activated, however, by the automatic trimming which is running in the background, if the second rotational speed limit is exceeded and with it the slow-travel range is exited.

In another embodiment, the surface drive is operated in four operating ranges, with a second operating range following with the increase in rotational speed in the slow-travel range beyond the second rotational speed limit, a third operating range following beyond a third rotational speed limit, and a fourth operating range following beyond a fourth rotational speed limit. Automatic trimming in the second and third operating ranges is controlled. In the fourth operating range, in which the drive reaches a defined maximum rotational speed, or the watercraft reaches its maximum headway speed, the trim angle is automatically set in a closed control loop.

In another variant, the trim angle varies within the trim range between an upper trim limit that specifies the angle of the thrust tube in which the propeller reaches its position of maximum height, and a lower trim limit that specifies the angle of the thrust tube in which the propeller assumes its lowest achievable position. Between these limits, there is a defined central position, which does not have to necessarily be the mathematical average of the trim limits.

In another embodiment of the invention, the trim angle is changed automatically from an arbitrary position that it assumed in the preceding operating range to the lower trim limit of the trim range when the changeover from the slow-travel range to the second operating range occurs with increasing rotational speed or headway speed.

In addition, adjustment of the trim angle to the lower trim limit can take place in the same way when changing from the third to the second operating range with a reduction of the rotational speed or the headway speed.

In one variant the trim angle is brought from the lower trim limit to the defined central position when a third operating range is reached from the second operating range.

In one variant the trim angle is shifted from the regulated position set for it in the fourth operating range to the central position of the third operating range, if the rotational speed or the headway speed drops and the fourth operating range changes to the third operating range.

In an advantageous refinement, it is possible for the skipper, especially in the third operating range in which the watercraft finds itself in a slipping state, to manually change the trim angle out of the central position within a correction range preset in the electronic control unit. This makes it possible to adapt to external influences, for example such as sea conditions. As in the slow-travel range, automatic trim control in this case remains active in the background and automatically changes the automatic trim mode if a third rotational speed limit is exceeded.

If the correction range is exceeded in the third operating range, the automatic trim control in an advantageous further embodiment of the invention switches to a first standby operating mode and adjustment of the trim angle is then possible only manually.

Termination of the automatic operating mode by the skipper, by means of a trim switch for example, is optionally possible.

In another variant, a manual reset, by means of a reset switch for example, is necessary for returning to automatic trim control.

In the changeover from the third to the fourth operating range by increasing the rotational speed or the headway speed of the watercraft, the trim angle set in the third operating range is first retained. Furthermore, when changing from the third to a fourth range in which the watercraft reaches its maximum headway speed and the motors are under full load, the operating mode automatically changes from controlling the trim angle to regulating the trim angle in a closed control loop. In this case the trim angle is changed so that a defined maximum rotational speed or maximum headway speed is reached.

In a special refinement, there are at least two drive units on a watercraft. Each drive unit in this case is driven by its own motor.

In one possible embodiment, in the operating ranges in which the trim angle is controlled according to a preprogrammed value table or function, the average of the rotational speeds of all of the drive units is calculated in the electronic control unit, and this average is taken as a rotational speed signal. In the same way, the trim angles of all of the drive units are adjusted synchronously in the controlled operating ranges, i.e. the trim angles are all the same in magnitude and direction.

In a further embodiment of the method pursuant to the invention with multiple drive units the trim angles of the individual drive units are—in the fourth operating range, in which the drive motors are under full load and at maximum motor rotational speed and the watercraft reaches its maximum headway speed—regulated independently of one another in a closed control loop so that the rotational speeds of the drive units reach a defined rotational speed. The difference between the rotational speeds of multiple drive units should advantageously not exceed a defined spread in this case.

As an alternative to this, the headway speed of the watercraft can be regulated by changing the trim angle to its maximum value.

In another variant, the maximum possible steering angle of the drive unit, i.e. the maximum possible lateral swing of the thrust tube to steer the watercraft, is reduced with increasing rotational speed or headway speed by the electronic control unit independently of the automatic operating mode of trimming. This happens in a possible variant according to a value table in which the steering angle in question is assigned a given rotational speed, or in another refinement according to a function of the rotational speed or the headway speed. Unstable operating conditions when negotiating curves are avoided by reducing the maximum achievable steering angle with rising headway speed or rotational speed, particularly at high headway speeds and with the narrow curve radii resulting from large steering angles.

Below the maximum steering angles that can be set are changeable as a function of the rotational or headway speed, which also cannot be exceeded during manual trimming, one variant features in the fourth operating range—where maximum headway speed is reached—a first limiting steering angle being additionally set in the electronic control unit, which when exceeded, the electronic control unit switches to a second standby operating mode and the trimming has to be performed manually until a second limiting steering angle is no longer exceeded and the automatic operating mode is thereby reactivated.

Another reason for influencing the automatic trimming by automatic limitation of the steering angle, particularly in surface drives that consist of at least two drive units, is the increasingly sloped position of the watercraft at high headway speed and a narrow curve radius that is produced by enlarging the steering angle. Beyond a given slope, for example the automatic trimming that regulates the trim angle in a closed control loop in the fourth operating range cannot move the thrust tube and with it the position of the propeller of the drive unit on the outside of the curve further down, so that the propeller on the outside of the curve rises out of the water while the propeller on the inside of the curve is deeply immersed. In one variant, automatic limitation of the steering angle variant prevents this operating state and/or allows manual correction of the trim angle after exceeding the first limiting steering angle in the second standby operating mode.

In another refinement of the method for a watercraft that has at least one trimming flap on each side of the transom, the trimming flaps are mounted on the transom to pivot around a trim angle around a parallel line to the transverse axis of the watercraft. Depending on the operating range, the trimming flaps are operated in a manner provided for them, with the motion of the trimming flaps, like that of the drive unit, being controlled by the electronic control unit and with the trimming flaps on both sides moving synchronously in direction and in trimming flap angle. This means that in the automatic operating mode, the left and right trimming flap angles are always the same. The trimming flaps are actuated by trimming flap actuators, for example hydraulic cylinders. When the trimming flaps are moved, this always occurs toward the trim angle of the drive unit.

The operation of the trimming flaps is preferably controlled automatically in all operating ranges, while the trimming flaps are adjusted manually in the slow-travel range.

In another refinement, the trimming flaps assist the trimming motion drive unit in the second operating range, in which the stern of the watercraft has to be raised during acceleration to arrive at the slip condition that characterizes the third operating range. The trimming flap angles assume their lower end value corresponding to the trim angle of the drive unit.

In one variant the trimming flap angles assume the range of a central position in the third operating range just like the trim angle of the drive unit, but can be adjusted manually in the same direction within a preset correction range. The correction range in this case is limited by an upper and a lower trimming flap correction limit.

In the changeover from the third to the fourth operating range, the trimming flap angles in another refinement pursuant to the invention remain at the last value that they had assumed in the third operating range and, in contrast to the trim angle of the drive unit, they are not regulated. In the fourth operating range, in which the trim angle is regulated in a closed control loop to reach the maximum rotational speed or the highest headway speed, it is possible to adjust the trimming flap angles manually within a preset correction range as in the third operating range.

In the event of manual correction of the trimming flap angle beyond the preset correction range, the electronic control unit optionally switches to the first standby operating mode in both the third and fourth operating ranges, in which only a manual change of the trim angle and the trimming flap angle remains possible.

In one variant automatic trimming flap control can be turned off manually, for example, by activating a trimming flap switch, so that the trimming flaps can be operated manually.

Adjustment of the trim angle of the drive unit and the thrust tube with the propeller shaft mounted in it to the lower limit of the trimming range is possible in manual operation as well as in the automatic operating mode, in particular in the second operating range. In this case the possibility exists of contacting the bottom of the waterway and thus the propeller or the propeller shaft as well as the thrust tube. In a particular refinement, to protect against hitting the bottom in at least the two operating ranges mentioned, a first vertical distance from a defined fixed point on the watercraft to the bottom is ascertained by a measuring device and is compared in the electronic control unit with a second vertical distance from the lowest point on the propeller to the fixed point. If downward adjustment of the trim angle threatens to make the second distance, plus an optional safety margin, exceed the first distance, the trim angle is automatically limited downward and the drive unit and the propeller can be moved no further downward.

In a variant of the preceding refinement, the trim angle is automatically reduced in the event that the water depth decreases while traveling in any operating range thereby correcting any possible exceeding of the first vertical distance by the second vertical distance.

BRIEF DESCRIPTION OF THE DRAWINGS

An example of embodiment of the invention is shown in the drawing and is described in detail below.

The Figures show.

DETAILED DESCRIPTION OF THE PREFERRED EMBODIMENTS

Figure 1:
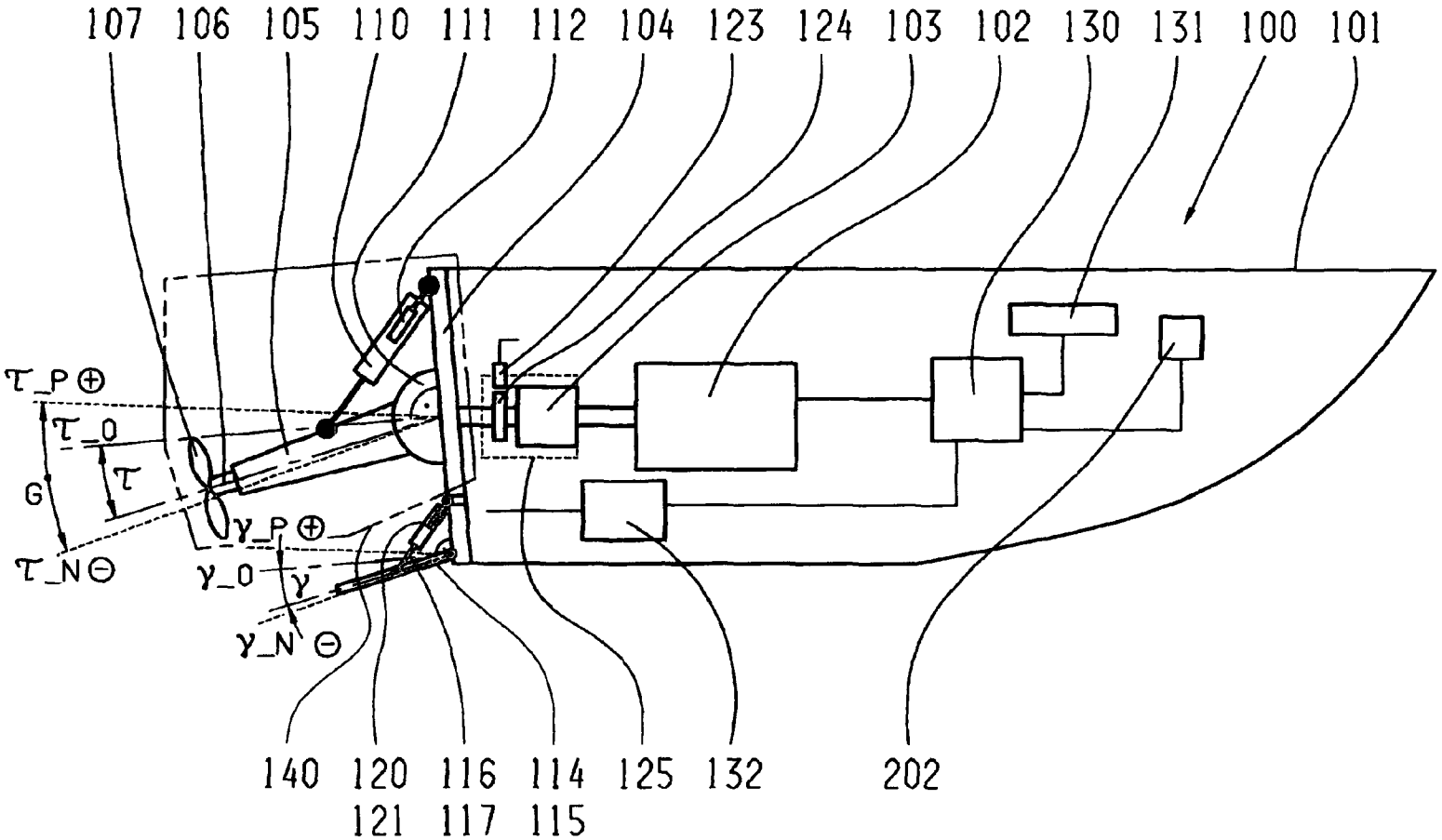
FIG. 1: a schematic side view of a watercraft with a surface drive.
Figure 2:
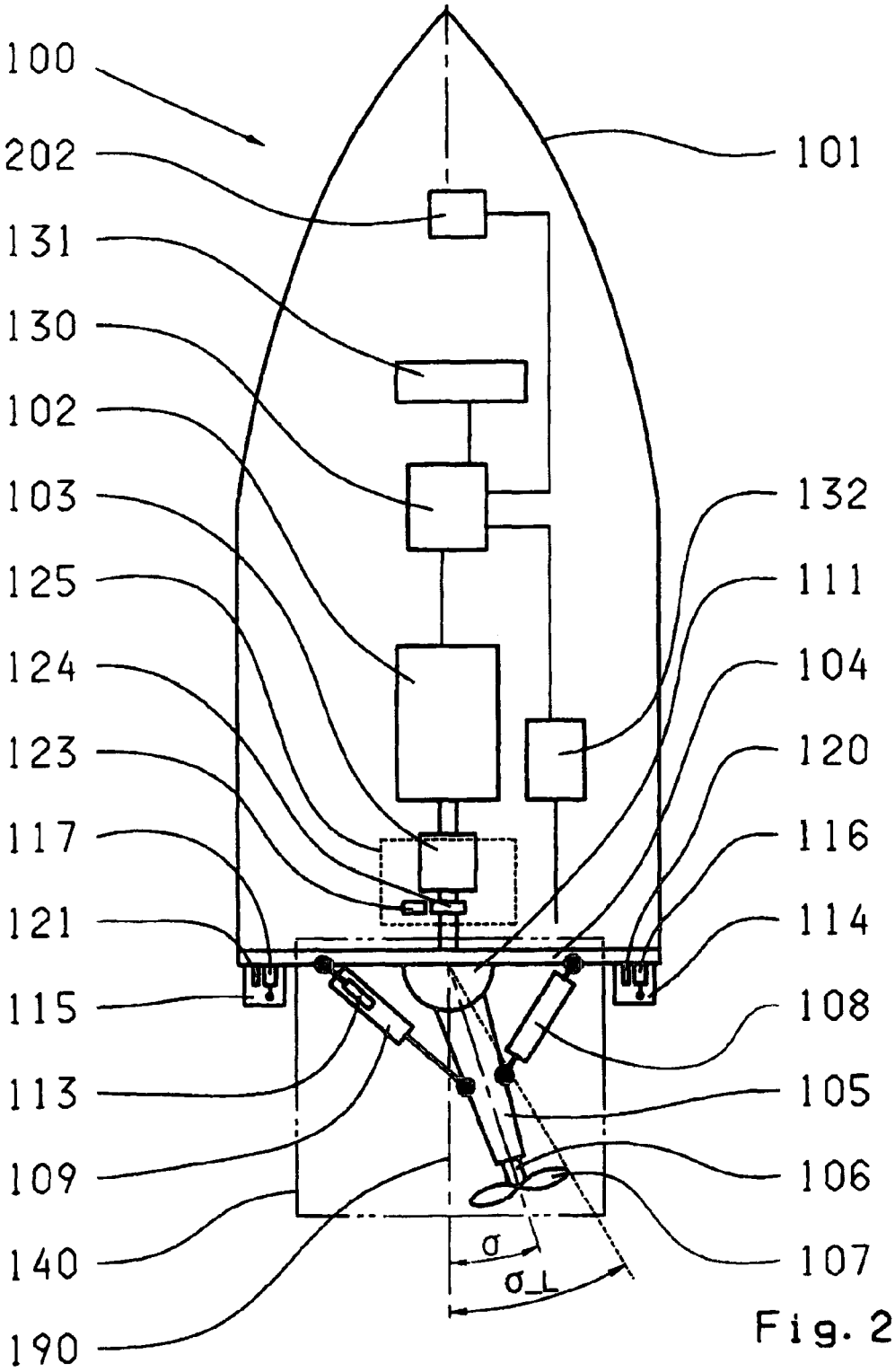
FIG. 2: a schematic top view of a watercraft with a surface drive.

FIGS. 1 and 2 show a watercraft 100 with a surface drive. The drive unit 140 of the surface drive is positioned in the stern on the hull 101 of the watercraft 100 and is connected to the transom 104. The drive unit 140 consists of the thrust tube 105 with the propeller shaft 106 and the propeller 107 as well as the steering actuator mechanism 108, 109 and the trimmer actuator mechanism 110. The propeller shaft 106, which has a propeller 107 the stern end, is mounted to rotate centrally in the thrust tube 105. The thrust tube 105 is connected to the transom 104 and the propeller shaft is connected to the drive train 125 that comes from the motor 102, and both are mounted to pivot in the hinge point 111. The drive train 125 includes a transmission 103. The rotational speed n, for example, is measured by a rotational speed sensor 123 on a slotted disk 124, the signal of which is detected by the electronic control unit 130. The pivoting motion in the horizontal plane, also called the steering motion, is brought about by the steering actuator mechanism consisting of two hydraulically actuated cylinders 108 and 109. The pivoting motion in the vertical plane, also called the trimming motion, is brought about by the trimming actuator mechanism, consisting of the hydraulically actuated trimming cylinder 110. Both motions are initiated by the electronic control unit 130, which controls the steering and trimming actuator mechanisms through a central hydraulic unit 132. The steering motion occurs within a maximally adjustable steering angle $\sigma_L$, measured from the longitudinal axis of the horizontal plane 190, as shown in FIG. 2. The measure of the steering motion of the drive unit 140 is the steering angle $\sigma$, which is measured from the longitudinal axis 190 as the neutral steering angle $\sigma_0=0°$. The measure of the trimming motion of the drive unit 140 is the trim angle $\tau$. The trimming motion occurs within an angle called the trimming range $\tau_G$ and limited by an upper trimming limit $\tau_P$ and a lower trimming limit $\tau_N$. The neutral trimming position τ_0, which is defined as τ_0=0°, is given in the side view by the perpendicular to the transom 104. In addition, two trimming flaps 114 and 115 are attached to the transom 104 on the left and right for trimming the watercraft 100, each of which is actuated by a trimming flap cylinder 116 and 117. The trimming flap cylinders 116 and 117 are likewise controlled by the electronic control unit 130 through the central hydraulic unit 132. The trimming flaps 114 and 115 in the automatic operating mode are adjusted in a synchronous manner to the other one, so that the right and left trim angles are always the same and are identified with the common trimming flap angle γ. Here the motion of the trimming flaps 114 and 115 is limited by an upper trimming flap limiting angle γ_P and a lower trimming flap limiting angle γ_N. Between them is the neutral position γ_0, which is present at the perpendicular to the transom 104 with the trim angle τ. The trimming flap motion is measured by path sensors 120 and 121 located in the trimming flap cylinders 116 and 117, respectively, and is detected in the electronic control unit 130 and is displayed like all of the measured parameters on the control panel 131.

Figure 3:
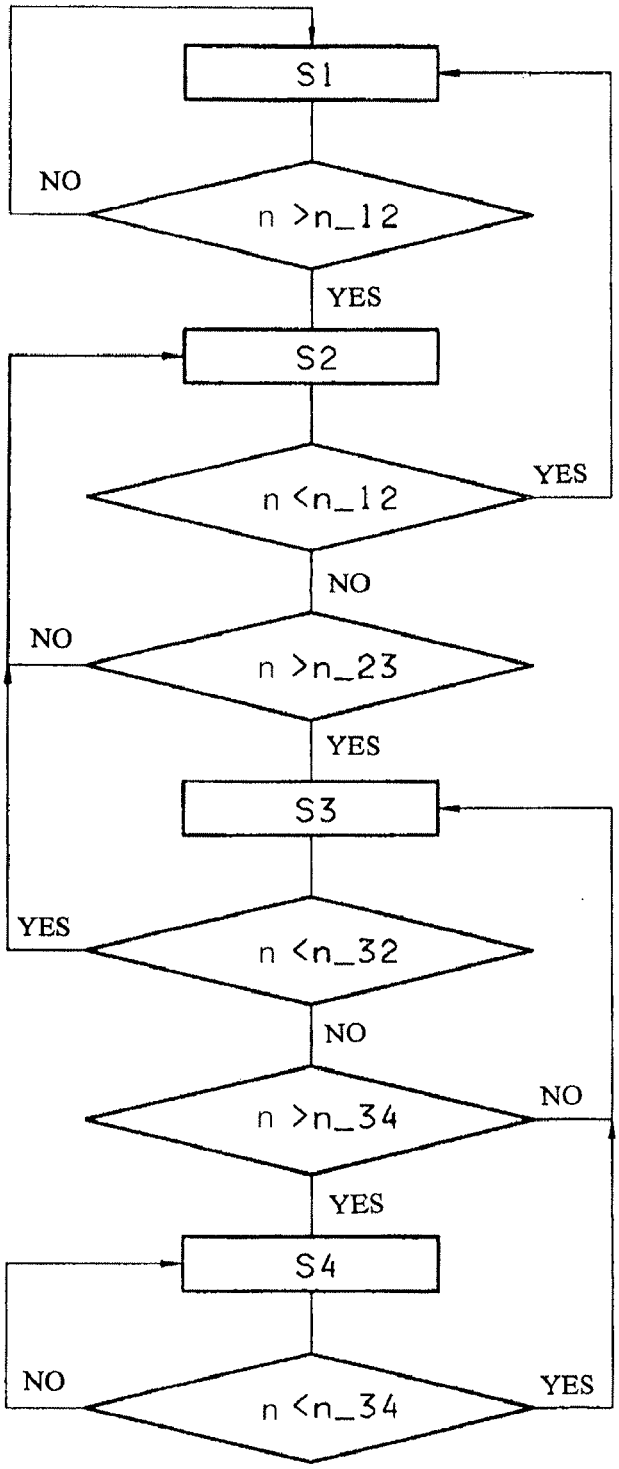
FIG. 3: a flow diagram for the automatic change of operating mode.

Using a flow chart, FIG. 3 illustrates the automatic change of operating mode as a function of the rotational speed n serving as a measure of the headway speed, and thus the operating ranges. Because of the fixed gear ratio of the transmission 103, all rotational speeds of the drive train 125 are proportional with one another, so that the rotational speed n is detected in the electronic control unit 130 factoring in the motor, transmission, or propeller shaft measurement point. A rotational speed sensor 123 with a slotted disk 124 or the information from a motor control is used as the rotational speed-measuring device, for example. In the slow-travel range S1, the rotational speed rises with accelerated travel from the initial rotational speed n_11 given by the idling speed of the motor. The watercraft is maneuvered in the slow-travel range S1, for example, in the way necessary for docking and undocking maneuvers. The current rotational speed n is compared in the electronic control unit 130 with a rotational speed limit n_12 programmed into the electronic control unit 130 from a stored value table or curve function. If the value of the current rotational speed n is greater than that of the rotational speed limit n_12, then the automatic trimming control changes into a second operating range S2 and the current trim angle τ assigned in the value table to the operating range S2 is determined. The electronic control unit 130 then emits as an output signal to the central hydraulic unit 132, which actuates the trimming actuator mechanism 180 consisting of the trimming cylinder 110 and its stroke sensor 122, and adjusts the drive unit 140 to the necessary trim angle τ. The second operating range S2 in case of accelerated travel is only a temporary operating range in which the trimming allows the changeover to a third operating range S3. If the rotational speed in the S2 operating range again drops below n_12, then the automatic trimming control reverts to the slow-travel range S1. In the event of an increase of rotational speed in the S2 operating range, and if a rotational speed limit n_23 is exceeded, the operating mode for the third operating range S3 is activated in the electronic control unit 130. S3 is the main operating range of the watercraft with surface drive, with the highest efficiency of the motor 102 or the propeller 104 also being reached here, for example. If the rotational speed n is again reduced in the S3 operating range and drops below a limiting rotational speed n_32, which is lower than n_23, the automatic trimming reverts to the mode for the S2 operating range. If a rotational speed limit n_34 is exceeded in the S3 operating range with further acceleration, then the mode for the fourth operating range S4 is activated in the electronic control unit 130. S4 is the operating range in which the motor under full load reaches its maximum rotational speed n_40 and the watercraft 100 reaches its highest headway speed. If the rotational speed n drops below n_34, the trim angle τ is adjusted according to the mode for the third operating range S3.

Figure 4:
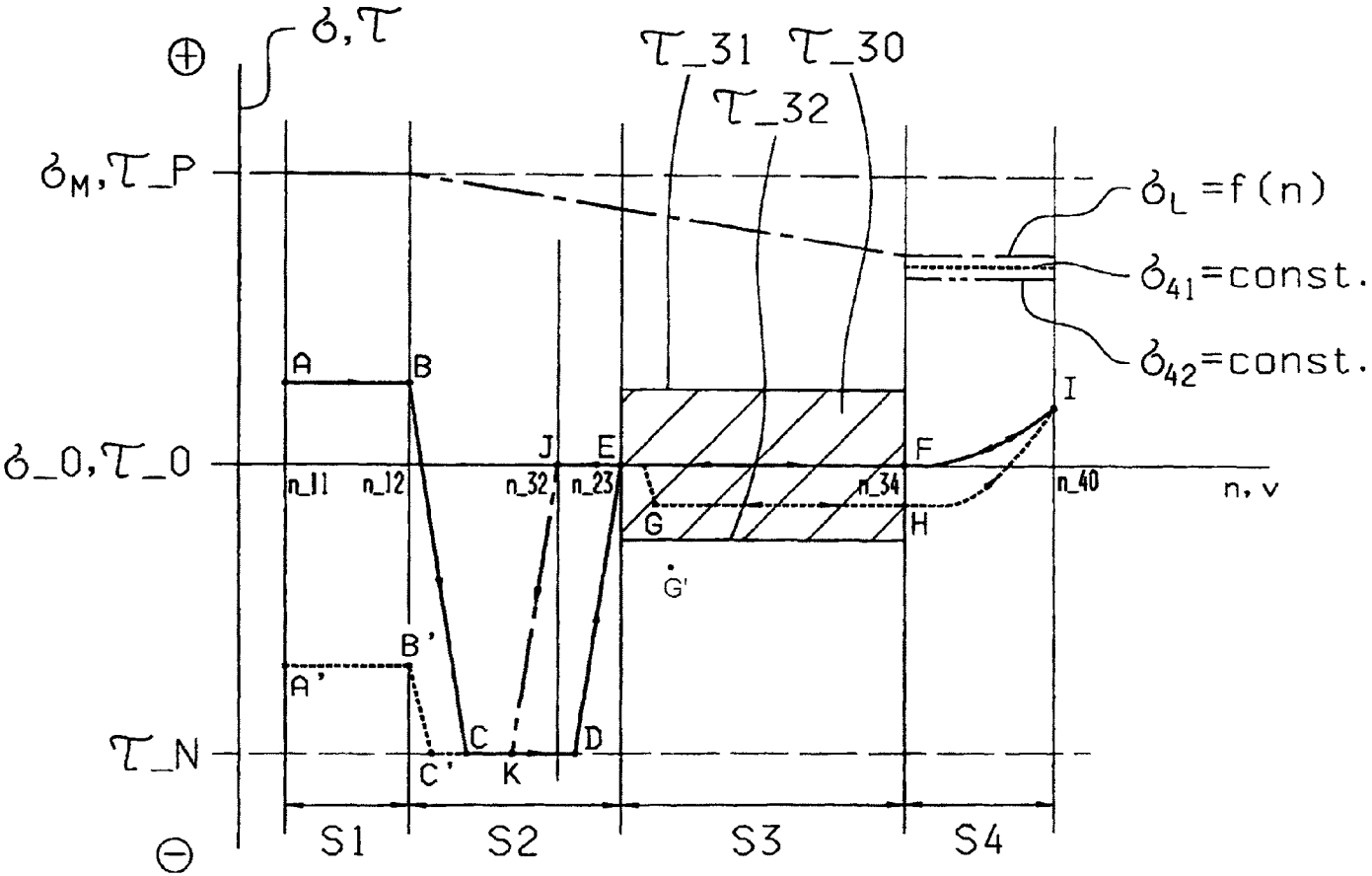
FIG. 4: a diagram with the curve of the trim angle versus rotational speed.

The diagram in FIG. 4 shows the curve of the trim angle τ versus the rotational angle n or versus the headway speed v proportional to the rotational speed n. In the slow-travel range S1 that begins above the idling rotational speed n_11, the trim angle τ can be freely selected by the skipper between an upper trimming limit τ_P and a lower trimming limit τ_N, as shown by the alternative trim angles at Point A or Point A'. Automatic trimming in this operating range is passive, i.e. the trim angle τ is not automatically controlled or regulated, but this is not equivalent to a manual operating mode since the electronic control unit 130 detects the rotational speed n or the headway speed v in the background and activates the automatic controlled setting of the trim angle τ for the second operating range S2 when the rotational speed limit n_12 that limits the slow-travel range S1 upward is exceeded, by the measured rotational speed n being detected in the electronic control unit 130, and the associated trim angle τ is then determined from a stored value table. In the second operating range S2 serving only as a transitional range between the slow-travel range S1 and a third operating range S3, which ends up in the slip phase described by the third operating range S3, adjustment of the trim angle τ to the lower trimming limit τ_N that is reached at Point C is necessary for lifting the stern of the watercraft 100. Because of the limited dynamics, the adjustment is not made suddenly but only with a timed gradient, whereby starting from Point B the trim angle τ falls at a finite rate of adjustment with a maximum gradient to the value of the lower trimming limit τ_N. The drive unit 140 stays there with increasing travel, until the approach to the third operating range S3 is computed in the electronic control unit 130 taking into account the gradient. The adjustment of the trim angle begins at Point D in such a way that when the rotational speed limit n_23 is exceeded, the drive unit 140 has reached the central position of the trim angle τ_0, which is defined, for example, with τ_0=0°. In the third operating range S3, starting at Point E, in which the watercraft 100 is operated most of the time, the trim angle τ can be corrected manually by the skipper within a correction range τ_30, for example to adapt the trim angle τ to the sea conditions. The upper correction limit τ_31, which is in the upper range, and the lower correction limit τ_32, in the negative range, of the correction range τ_30, are stored in the electronic control unit 130. Thus the entire trimming range τ_G=τ_P−τ_N amounts to 15°, for example, with the upper trimming limit τ_P at +7° and the lower trimming limit at −8°. The central position of the trim angle of τ_0=0° is given by the perpendicular to the transom 104. The correction range τ_30 extends, for example, over 4°, divided symmetrically to the central position τ_0=0° with τ_31=+2° for the upper correction limit for trimming in S3 and −2° for the lower correction limit τ_32 for trimming in S3. In rough seas, for example, the trim angle τ is to be corrected by the skipper into the negative range toward the lower correction limit τ_32 for trimming in the S3 operating range (see Point G). If the correction range is exceeded (Point G') during manual correction of the trim angle τ, the trimming control switches to a first standby operating mode and leaves the automatic operating mode so that the trim angle τ continues to be adjustable only manually. The electronic control unit also switches into the first standby operating mode under alarm conditions and for system failures. Examples of alarm conditions are excessively high oil temperature or excessively low oil level in a hydraulic unit. System failures mean, for example, excessively low electrical supply voltage or an error in the CAN-BUS connection.

It is possible to return to the automatic operating mode only by a manual reset, for example such as actuating a reset switch, whereby the trim angle τ again assumes the central position τ_0=0°. When the rotational speed drops in the third operating range S3 (Line E-J), the automatic operating mode of the second operating range S2 comes into play only beyond a rotational speed n_32 that is lower than the rotational speed n_23 (Line E-J-K). This hysteresis prevents constant interchange of operating modes in the changeover range.

If the limiting headway speed n_34 is exceeded with an increase of rotational speed in the third operating range S3, the trim angle τ stays in the last value set in the third operating range S3 (Point F or H), and is changed in a closed control loop with the activation of the operating mode for the fourth operating range S4 so that a maximum rotational speed n_40 and maximum headway speed v_max are reached (Point I). With an arrangement of multiple drive units 140, each of which is driven by its own motor 102 through its own drive train 125, the trim angles τ are adjusted independently of one another to reach a maximum rotational speed n_40, with the rotational speeds of the individual drive units 140 being regulated so that they lie together in a narrow tolerance range, for example of 10 rpm. If the skipper attempts to adjust the trim angle τ manually, the first standby operating mode is activated. In addition to automatic setting of the trim angle, an automatically increasing limitation of the maximum achievable steering angle σ_L=f(n, v) is possible through the rotational speed n or the headway speed v, to prevent critical states when negotiating curves. In addition to the trim angle τ, the steering angle σ is also plotted on the ordinate of the diagram. The broken line reflects a possible curve of the maximum achievable steering angle σ_L versus the rotational speed n or the headway speed v. The maximum steering angle σ_L that can be set still reaches its maximum value in the slow-travel range S1, and is reduced starting with the operating range S2 according to a function or a value table stored in the electronic control unit, within which values can be interpolated. It is also impossible to exceed the maximum achievable steering angle σ_L with the automatic trimming turned off or in the first standby operating mode. In the fourth operating range S4, in which the maximum steering angle σ_L that can be set is the smallest because of the high rotational speed and headway speed, a first limiting steering angle σ_41 lies below the maximum achievable steering angle σ_L. Exceeding the first limiting steering angle σ_41 first triggers an optical and/or acoustic signal for the skipper, and as the steering angle σ continues to increase, the electronic control unit switches into the second standby operating mode in which the automatic regulation of the trim angle is turned off and trimming again has to be done manually until the steering angle σ is reduced to such an extent that it is again smaller than the second limiting steering angle σ_42. The two limiting steering angles σ_41 and σ_42 can be the same. To avoid constant switching back and forth, a hysteresis is provided for, and the first limiting steering angle σ_41 for being exceeded is larger than the second limiting steering angle σ_42, dropping below which again activates the automatic regulation of the trim angle τ in the fourth operating range S4. In the example described, the limiting steering angles σ_41 and σ_42 in the fourth operating range S4 due to its brevity are constant. The same is true of the maximum possible steering angle σ_L. Of course a variable curve depending on the rotational speed n or the headway speed would also be conceivable.

Figure 5:
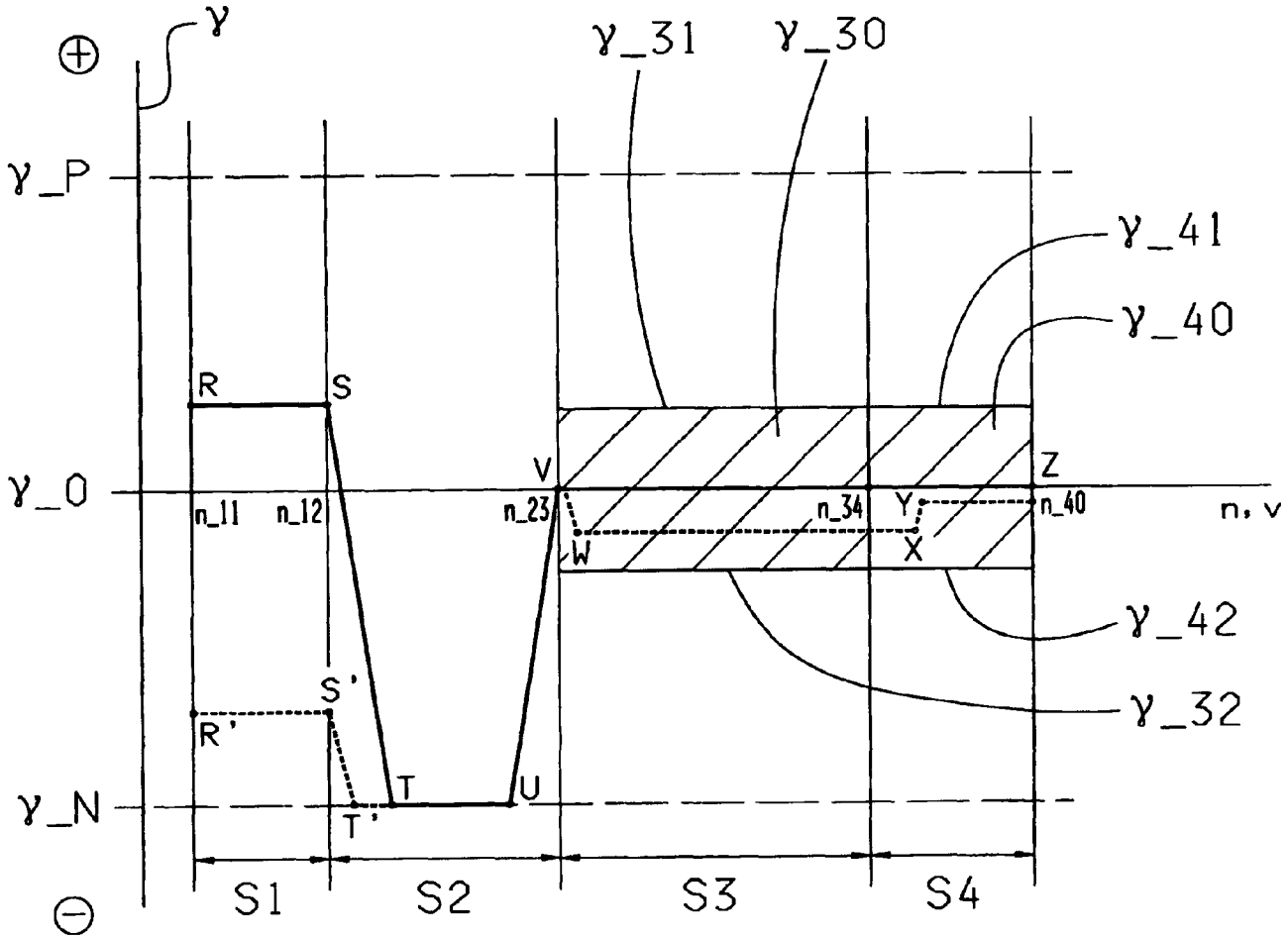
FIG. 5: a diagram with the curve of the trimming flap angle versus rotational speed.

FIG. 5 shows a diagram with the curve of the trimming flap angles γ_L and γ_R, with the ordinate labeled with the common trimming flap angle γ because of the synchronous adjustment of the trimming flaps in the automatic operating mode. The trimming flap angle can be modified at a maximum between an upper trimming flap angle limit γ_P and the lower trim limit γ_N. The rotational speed n and the headway speed v, proportional to the rotational speed n, are plotted on the abscissa. Similarly to the trim angle τ in FIG. 4, the trimming flap angle γ is manually adjustable in the slow-travel range S1 (Points R-S or R'-S') starting with the initial rotational speed n_11, between the upper γ_P and the lower γ_N trimming flap angle limits. In the operating range S2, which begins at the rotational speed limit n_12, the trimming flap angle γ is adjusted to the lower trimming flap angle limit γ_N (S-T or S'-T'), corresponding to the trim angle τ from the automatic control. Also analogously to the trim angle τ, adjustment of the trimming flap angle γ begins with the approach to the operating range S3 at Point U in the central trimming flap position γ_0, which is defined, for example, with γ_0=0°, and is reached at Point V with the rotational speed limit n_23. In the entire third operating range S3 and the fourth operating range S4 (V-Z), the trimming flap angle γ remains in the central trimming flap position γ_0, of course with manual correction being possible within a correction range γ_30 in the third operating range S3 and within a correction range γ_40 in the fourth operating range S4. Exceeding the upper correction limit γ_31 or γ_41, or the lower correction limit γ_32 or γ_42 by manual adjustment of the trimming flap angle γ in the third or fourth operating range S3 or S4 leads to the first standby operating mode. Both in the third operating range S3 and in the fourth operating range S4, the particular operating mode of automatic trimming is therefore terminated and adjustment of the trim angle τ and trimming flap angle γ has to be done manually. Return to the automatic operating mode is possible only by a reset, for example such as actuating the reset switch 310, which results in both the trimming flap angle γ and the trim angle τ again assume the central position γ_0=0°. The central trimming flap position γ_0 and drive position τ_0 are each determined by a line that is perpendicular to the transom 104, so that the two central positions of the drive (104) and of the trimming flaps (114, 115) are the same. The end positions are different, on the other hand. Thus the upper trimming flap angle limit γ_P, for example, is +5°, and the lower trimming flap angle limit γ_N=−15°. Manual adjustment of the trimming flap angle γ within the correction range γ_30 is shown by the line along the points V-W-X. When changing from the operating range S3 to the operating range S4, the value of the trimming flap angle γ is retained. From point X to Point Y, for example, the lower trimming flap angle γ is reduced in the fourth operating range S4, and remains unchanged until the rotational speed n_40 is reached. The trimming flap angle γ is controlled in the operating ranges S2, S3, and S4, and regulation does not occur.

Figure 6:
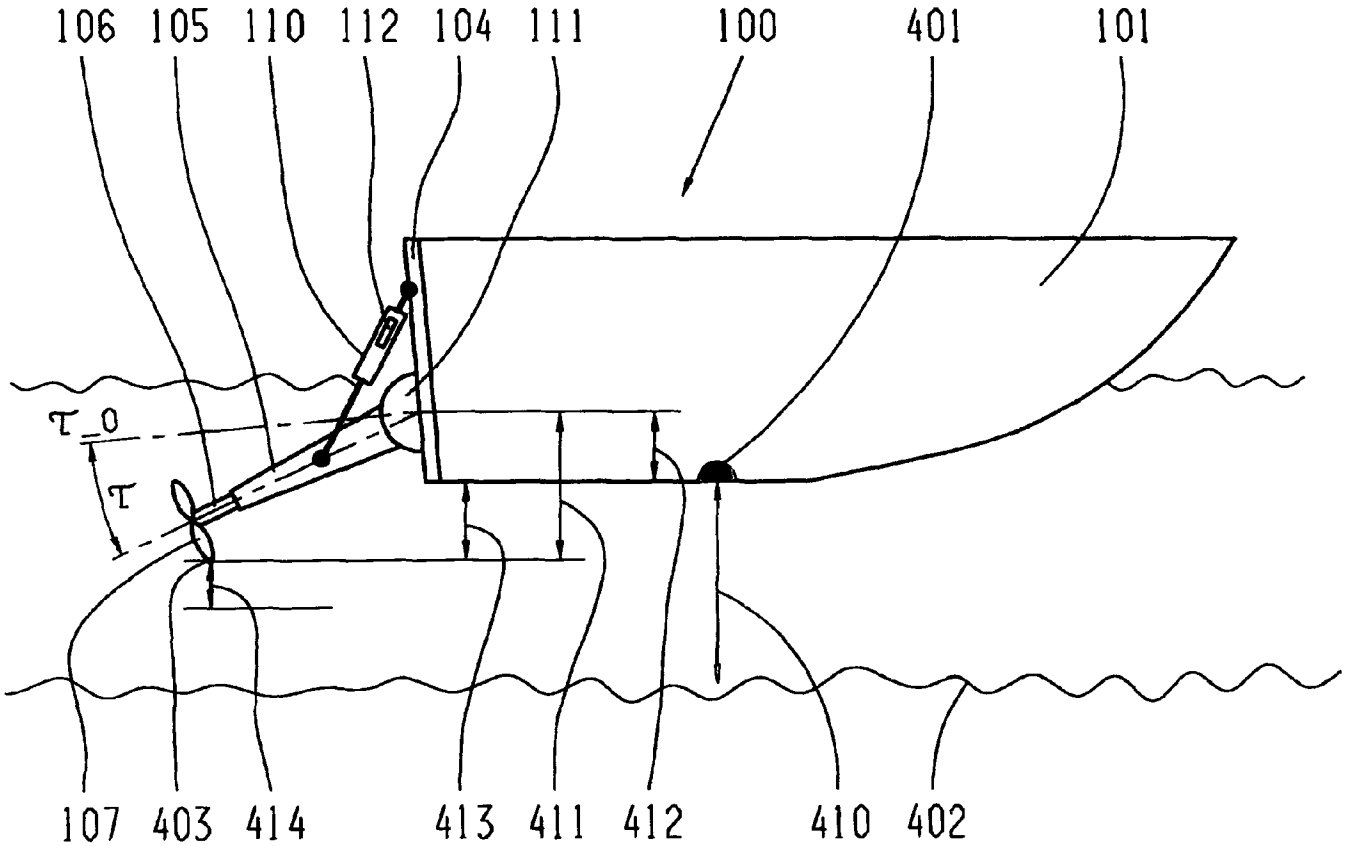
FIG. 6: a schematic representation of the measurement of the vertical distance from the bottom of the body of water for a watercraft with a surface drive.

FIG. 6 shows a distance measurement between the bottom outside diameter 403 of the propeller 107 that represents the lowest place on the drive unit 140, and the bottom of the waterway 402. The perpendicular distance 410 from the lowest point of the hull 101 in this example to the bottom 402 is measured by a distance sensor 401 fastened to the hull 101 of the watercraft 100. The perpendicular distance 411 of the bottom outside diameter 403 of the propeller 107 to the center of the hinge 111 is calculated in the electronic control unit 130, for example from the indirect measurement of the trim angle τ with the trimming cylinder stroke sensor 112 located in the trimming cylinder 110. The perpendicular distance 413 from the lowest place on the hull 101 to the lowest point on the propeller 107 is calculated using the known perpendicular distance 412 from the center of 111 to the height of the distance sensor 401, which in the drawing is attached to the lowest point on the hull 101. If the perpendicular distance 413 is greater than the perpendicular distance 410, the propeller 107 collides with the bottom 402. For this reason, the perpendicular distances 410 and 413 are measured or calculated continually and are compared with one another in the electronic control unit 130. When 413 approaches 410, automatic or manual adjustment of the trim angle τ shifts the lower trim limit τ_N so that a collision with the bottom is prevented. In addition, a perpendicular safety margin 414 can be taken into consideration. If the water depth and with it the perpendicular distance 410 is reduced during the trip, then the trim angle τ can be changed toward the upper trim limit τ_P if an impending collision of the propeller 107 with the bottom 402 is calculated.

REFERENCE LABELS

100 Watercraft
101 Hull
102 Drive motor
103 Transmission
104 Transom
105 Thrust tube
106 Propeller shaft
107 Propeller
108 Right steering cylinder
109 Left steering cylinder
110 Trimming cylinder
111 Hinge point
112 Trimming cylinder stroke sensor
113 Steering cylinder stroke sensor
114 Right trimming flap
115 Left trimming flap
116 Right trimming flap cylinder
117 Left trimming flap cylinder
120 Right trimming flap sensor
121 Left trimming flap sensor
123 Propeller shaft rotational speed sensor
124 Slotted disk
125 Drive train
130 Electronic control unit
131 Control panel
132 Central hydraulic unit
140 Drive unit
190 Longitudinal axis
200 Propeller rotational speed
201 Headway speed
202 Headway speedometer
401 Distance sensor
402 Bottom of waterway
403 Lowest point on the outside diameter of propeller 107
410 Perpendicular distance between 401 and 402
411 Perpendicular distance between 111 and 403
412 Perpendicular distance between 111 and 401
413 Perpendicular distance between 401 and 403 (difference 411-412)
414 Perpendicular safety margin between 403 and 402
S1 First operating range
S2 Second operating range
S3 Third operating range
S4 Fourth operating range
n_11 Initial rotational speed of S1
n_12 Rotational speed limit from S1 to S2
n_23 Rotational speed limit from S2 to S3
n_32 Rotational speed limit from S3 to S2 (for deceleration)
n_34 Rotational speed limit from S3 to S4
n_40 Maximum rotational speed of S4
v Headway speed of the watercraft
γ Common trimming flap angle
γ_R Right trimming flap angle
γ_L Left trimming flap angle
γ_P Upper trimming flap limiting angle
γ_N Lower trimming flap limiting angle
γ_0 Central position of the trimming flap angle
γ_30 Trimming flap correction range in S3
γ_31 Upper trimming flap correction limit in S3
γ_32 Lower trimming flap correction limit in S3
γ_40 Trimming flap correction range in S4
γ_41 Upper trimming flap correction limit in S4
γ_42 Lower trimming flap correction limit in S4
σ Steering angle
σ_L Maximum achievable left, right steering angle, f(n)
σ_0 Neutral position of the steering angle
σ_41 Limiting steering angle in the S4 operating range (exceeding)
σ_42 Limiting steering angle in the S4 operating range (falling below)
τTrim angle
τ_P Upper trim limit
τ_N Lower trim limit
τ_0 Central position of the trim angle
τ_G Trim range
τ_30 Correction range for trimming in S3
τ_31 Upper correction limit for trimming in S3
τ_32 Lower correction limit for trimming in S3

The invention claimed is:

1. A method of controlling a surface drive for a watercraft (100) with at least one drive unit (140) comprising a thrust tube (105) which directs a propeller shaft (106) and trimming and steering actuator mechanisms (180, 181) that are controlled by an electronic control unit (130), the thrust tube (105) being vertically pivotable within a trimming range (τ_G) around a trim angle (τ) around a hinge point (111) attached to a transom (104) and horizontally pivotable within a maximum steering angle (σ_L) around a steering angle (σ), the propeller shaft (106) being hingedly connected to a drive train (125) at the hinge point (111), and the surface drive being operable in at least one automatic operating mode and at least two different operating ranges (S3, S4), the method comprising the steps of:

automatically changing the operation mode when the operating range changes;

automatically controlling the adjustment of the trim angle (τ) in at least one controlled operating range (S3) in a controlled automatic operating mode, with the detection of values of preset control parameters, where the automatic control adjusts the trim angle (τ) to achieve a preset desired trim angle (τ); and automatically regulating the adjustment of the trim angle (τ) in a closed control loop in at least one regulated operating range (S4) in a regulated automatic operating mode, with detection of values of preset control parameters, where the automatic regulation adjusts the trim angle (τ) to achieve either a defined maximum rotational speed (n_40) or a maximum headway speed of the watercraft (v_40).

2. The method of controlling the surface drive for the watercraft according to claim 1, further comprising the step of defining each of the operating ranges by either an upper and a lower rotational speed limit or an upper and a lower headway speed limit of the watercraft (100), and the rotational speed (n) is the rotational speed of one of a motor (102), the drive train (125) and the propeller shaft (106).

3. The method of controlling the surface drive for the watercraft according to claim 1, further comprising the steps of one of:

acquiring the trim angle (τ) to be set as a function of either a rotational speed (n) or a headway speed (v), in a controlled operating range, from a value table stored in the electronic control unit (130), where intermediate values are interpolated, and calculating the trim angle (τ) from a stored function.

4. The method of controlling the surface drive for the watercraft according to claim 2, further comprising the steps of, in at least one operating range (S2), defining a higher upper rotational speed limit (n_23) if the watercraft is currently operating in the at least one operating range, and a lower upper rotational speed limit (n_32) if the watercraft is decelerating into the at least one operating range from an adjacent faster operating range (S3).

5. A method of controlling a surface drive for a watercraft (100) with at least one drive unit (140) comprising a thrust tube (105) which directs a propeller shaft (106) and trimming and steering actuator mechanisms (180, 181) that are controlled by an electronic control unit (130), the thrust tube (105) being vertically pivotable within a trimming range (τ_G) around a trim angle (τ) around a hinge point (111) attached to a transom (104) and horizontally pivotable within a maximum steering angle (σ_L) around a steering angle (σ), the propeller shaft (106) being hingedly connected to a drive train (125) at the hinge point (111), and the surface drive being operable in at least one automatic operating mode and at least two different operating ranges (S3, S4), the method comprising the steps of:

automatically controlling the adjustment of the trim angle (τ) in at least one controlled operating range (S3) in a controlled automatic operating mode, with the detection of values of preset control parameters, where the automatic control adjusts the trim angle (τ) to achieve a preset desired trim angle (τ);

automatically regulating the adjustment of the trim angle (τ) in a closed control loop in at least one regulated operating range (S4) in a regulated automatic operating mode, with detection of values of preset control parameters, where the automatic regulation adjusts the trim angle (τ) to achieve a desired speed (n, v);

providing a slow-travel range besides the at least one controlled operating range and the at least one regulated operating range, for slow travel (S1) starting at a first rotational speed limit (n_11), in which automatic trimming is passive, such that the trim angle (τ) is set as desired by an operator with the trimming range (τ_G); and engaging automatic trimming only upon leaving the slow-travel range (S1).

6. The method of controlling the surface drive for the watercraft according to claim 1, further comprising the steps of operating the surface drive in four operating ranges, with a second operating range (S2) following with an increase in rotational speed (n) during a slow-travel range (S1) beyond a second rotational speed limit (n_12); a third operating range (S3) following beyond a third rotational speed limit (n_23); a fourth operating range (S4) following beyond a fourth rotational speed limit (n_34); controlling the automatic trimming during the second operating range (S2), the third operating range (S3) and regulating the automatic trimming during the fourth operating range (S4), in which either a maximum rotational speed (n_40) or a highest headway speed of the watercraft (v_40) is reached.

7. The method of controlling the surface drive for the watercraft according to claim 1, further comprising the step of, during a second operating range (S2), automatically adjusting the trim angle (τ) to a lower trim limit (τ_N) of the trimming range (τ_G).

8. The method of controlling the surface drive for the watercraft according to claim 1, further comprising the step of, during a third operating range (S3), automatically adjusting the trim angle (τ) to a central position (τ_0).

9. The method of controlling the surface drive for the watercraft according to claim 6, further comprising the steps of, during the third operating range (S3), manually adjusting the trim angle (τ) within a correction range (τ_30) defined in the electronic control unit (130), with the automatic operating mode remaining active, and the correction range (τ_30) is smaller than the maximum trimming range (τ_G).

10. The method of controlling the surface drive for the watercraft according to claim 9, further comprising the steps of switching, with the electronic control unit (130), to a first standby operating mode and terminating the automatic operating mode, when during the third operating range (S3) and when either an upper correction limit (τ_31) for trimming is exceeded or a lower correction limit (τ_32) is undershot, such that only the operator can continue to change the trim angle (τ) of the surface drive manually.

11. The method of controlling the surface drive for the watercraft according to claim 10, further comprising the step of restoring the automatic operating mode from the first standby operating mode only by actuating a manual reset.

12. The method of controlling the surface drive for the watercraft according to claim 6, further comprising the steps of, during the slow-travel range (S1), the second operating range (S2) and the third operating range (S3), synchronously adjusting the trim angles (τ) of individual drive units (140) in a watercraft comprising at least two drive units (140) and where an average rotational speed of the individual drive units (140) is a rotational speed signal.

13. The method of controlling the surface drive for the watercraft according to claim 6, further comprising the step of automatically regulating the trim angles (τ) of the each of the at least one drive units (140), in a closed control loop independently of one another, during the fourth operating range (S4), such that each of the drive units (140) reaches either a defined maximum rotational speed (n_40) or a defined maximum headway speed (v_40) of the watercraft (100).

14. The method of controlling the surface drive for the watercraft according to claim 1, further comprising the step of reducing, independently of the automatic trimming, a maximum possible steering angle (σ_L), when a rotational speed (n) increases as a function of either the rotational speed (n) or a headway speed (v), to prevent unstable travel situations at high headway speeds (v) and large steering angles (σ) for safety reasons.

15. The method of controlling the surface drive for the watercraft according to claim 6, further comprising the step of terminating trimming in the automatic operating mode, during the fourth operating range (S4), when a first limiting steering angle (σ_41) defined in the electronic control unit (130), which is smaller than a maximum possible steering angle (σ_L) at either a rotational speed (n) or headway speed (v) of the fourth operating range (S4), is exceeded, and switching to a second standby operating mode in which the trim angle (τ) is adjusted manually until the steering angle (σ_L) again falls below a second limiting steering angle (σ_42) and a second standby operating mode is exited, whereby the automatic regulation of the trim angle (τ) becomes active again.

16. The method of controlling the surface drive for the watercraft according to claim 15, further comprising the step of the first limiting steering angle (σ_41) being larger than a second limiting steering angle (σ_42).

17. The method of controlling the surface drive for the watercraft according to claim 1, further comprising the steps of assisting the drive unit (140) of a watercraft that comprises at least one trimming flap (114, 115) on both a left side and a right side of the transom (104), by synchronously adjusting the two trimming flaps (114, 115) in the automatic operating mode around an identical trimming flap angle (γ) within an upper trimming flap limiting angle (γ_P) and a lower trimming flap limiting angle (γ_N).

18. The method of controlling the surface drive for the watercraft according to claim 7, further comprising the step of assisting the drive unit (140) of a watercraft that comprises at least one trimming flap (114, 115) on both a left side and a right side of the transom (104), by synchronously two trimming flaps (114, 115) in the automatic operating mode around an identical trimming flap angle (γ) within an upper trimming flap limiting angle (γ_P) and a lower trimming flap limiting angle (γ_N);

adjusting the two trimming flaps (114, 115), during the second operating range (S2), to the lower trimming flap limiting angle (γ_N).

19. The method of controlling the surface drive for the watercraft according to claim 8, further comprising the step of assisting the drive unit (140) of a watercraft that comprises at least one trimming flap (114, 115) on both a left side and a right side of the transom (104), by synchronously adjusting the two trimming flaps (114, 115) in the automatic operating mode around an identical trimming flap angle (γ) within an upper trimming flap limiting angle (γ_P) and a lower trimming flap limiting angle (γ_N);

adjusting the two trimming flaps (114, 115), during the third operating range (S3), to their central position (γ_0).

20. The method of controlling the surface drive for the watercraft according to claim 9, further comprising the steps of assisting the drive unit (140) of a watercraft that comprises at least one trimming flap (114, 115) on both a left side and a right side of the transom (104), by synchronously adjusting the two trimming flaps (114, 115) in the automatic operating mode around an identical trimming flap angle (γ) within an upper trimming flap limiting angle (γ_P) and a lower trimming flap limiting angle (γ_N);

manually correcting a trimming flap angle (γ), during the third operating range (S3), in a preset trimming flap correction range (γ_30) in a same direction as a correction of the trim angle (τ), and exceeding an upper trimming flap correction limit (γ_31) or falling below a lower trimming flap correction limit (γ_32) brings about a switch into a first standby operating mode.

21. The method of controlling the surface drive for the watercraft according to claim 17, further comprising the steps of retaining the trimming flap angle (γ), when changing from a third operating range (S3) to a fourth operating range (S4), at a last value that the trimming flap angle (γ) assumed during the third operating range (S3), and manually adjusting the trimming flap angle (γ) during the fourth operating range (S4) within a preset trimming flap correction range (γ_40) that is limited by an upper trimming flap correction limit (γ_41) and a lower limit (γ_42), with the electronic control unit (130) switching to a first standby operating mode upon leaving the trimming flap correction range (γ_40), and thus disabling the automatic regulation of the trim angle (γ).

22. The method of controlling the surface drive for the watercraft according to claim 1, further comprising the steps of protecting a propeller (107) of the watercraft when the thrust tube (105) is lowered which increases a likelihood of the drive unit (140) colliding with a bottom (402) of the waterway, by measuring a first perpendicular distance (410) from a distance sensor (401) located on the watercraft (100) to the bottom (402) of the waterway with the distance sensor (401) and comparing with the electronic control unit (130), the first perpendicular distance (410) to a second perpendicular distance (413) measured from a lowest point (403) of the drive unit on an outside diameter of the propeller (107), calculating a position of the outside diameter of the propeller (107) from an intended trim angle (τ) to the vertical position of the distance sensor (401), with a lower trimming limit (τ_N), which limits the trim angle (τ) downward, being shifted correspondingly upward in case a desired downward excursion (413) of the drive unit drops below the first perpendicular distance (410).

23. The method of controlling the surface drive for the watercraft according to claim 22, further comprising the step of, if a collision of the drive unit (140) with the bottom (402) of the waterway is predicted while traveling, automatically reducing a magnitude of the trim angle (τ) toward an upper trimming limit (τ_P).

* * * * *